US006495201B2

(12) United States Patent
Duda et al.

(10) Patent No.: US 6,495,201 B2
(45) Date of Patent: Dec. 17, 2002

(54) PROCESS FOR THE MULTI-LAYER REPAIR COATING OF SUBSTRATES

(75) Inventors: Andrew Duda, Gladbeck (DE); Guenter Berschel, Cologne (DE); Wolfgang Feyrer, Cologne (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/965,042

(22) Filed: Sep. 27, 2001

(65) Prior Publication Data

US 2002/0039621 A1 Apr. 4, 2002

Related U.S. Application Data

(63) Continuation of application No. 09/549,428, filed on Apr. 17, 2000, now abandoned.

(51) Int. Cl.[7] ..... B05D 1/36; B05D 7/14; B05D 7/16

(52) U.S. Cl. ..... 427/142; 427/140; 427/256; 427/258; 427/265; 427/286; 427/287; 427/407.1; 427/409; 427/421

(58) Field of Search ..... 427/140, 142, 427/256, 258, 265, 286, 287, 409, 407.1, 421

(56) References Cited

U.S. PATENT DOCUMENTS

| | | | | | |
|---|---|---|---|---|---|
| 5,633,037 | A | * | 5/1997 | Mayer | 427/140 |
| 5,683,745 | A | * | 11/1997 | Liedtke et al. | 427/140 |
| 5,820,986 | A | * | 10/1998 | Topfel | 428/411.1 |
| 5,849,365 | A | * | 12/1998 | Topfel | 427/421 |
| 5,871,809 | A | * | 2/1999 | Liedtke et al. | 427/140 |
| 6,099,912 | A | * | 8/2000 | Borgholte et al. | 427/407.1 |

* cited by examiner

*Primary Examiner*—Schrive P. Beck
*Assistant Examiner*—Jennifer Kolb Michener
(74) *Attorney, Agent, or Firm*—Sudhir G. Deshmukh

(57) ABSTRACT

A process for the multi-layer repair coating of substrates, wherein a base coat layer of a water-based base coat coating composition is applied to a precoated substrate and a clear coat layer of a transparent clear coat coating composition is applied to the base coat layer thus obtained, characterised in that the base coat layer of the colour- and/or special effect-imparting water-based base coat coating composition is applied in three successive spray passes, and each spray pass is executed such that uniform, adjacent and substantially non-overlapping coating strips are applied to the substrate surface to be coated.

7 Claims, No Drawings

PROCESS FOR THE MULTI-LAYER REPAIR COATING OF SUBSTRATES

This application is a continuation of 09/549,428 filed on Apr. 17, 2000, which was abandoned.

BACKGROUND OF THE INVENTION

The invention relates to a process for the multi-layer repair coating of substrates with colour- and/or special effect-imparting water-based base coats and with transparent clear coats. The process may find application in particular in vehicle repair coating.

For ecological reasons, water-based coatings are also being used to an increasing extent in vehicle repair coating. However, the coatings obtained with water-based coatings do not yet achieve the high level of quality of conventional solvent-based coatings in terms of all the properties. For example, wetting faults in respect of the substrate may occur during the application of water-based base coats. Further disadvantages are the visual appearance of the coating layers applied which is still unsatisfactory at times, such as, for example, the clouding tendency, inadequate clear coat stability during coating over with clear coats and, in the case of special effect water-based base coats, an insufficient special effect development. The relatively long flash-off and drying times are generally a disadvantage when water-based coatings are used.

There has been no lack of attempts hitherto to overcome or at least mitigate the disadvantages of the prior art, for example, by appropriate binder developments and adapted coating composition formulations. The application parameters such as atomization parameters (nozzle parameters) or sequence of application and method of application of the coating material also have a substantial effect on the visual appearance of a coating. For the application of water-based base coats, for example, it has been proposed in the past to apply the coating compositions in one operation comprising a preceding thin spray pass and a subsequent normal spray pass ("Anwendungstechnische Information" Spies Hecker; Permahyd® Base coat series 280, water-dilutable; A-data sheet no. 100.0/03/97-D).

In the same way, it is possible to operate with two normal spray passes followed, in the case of special effect coatings, by an additional over-spraying spray pass (Technical Data Sheet Chromax® "Basislacksystem auf Wasserbasis"; REF Chromax-3-D of 09.12.1998).

Moreover, a process for repair coating with aqueous metallic and special effect base coats is described in EP-A-729 390, for example, wherein the water-based base coat is applied to the prepared surface of an existing coating in a first spray pass until a boundary is reached and the surface thus coated is then coated with the water-based base coat in a second spray pass. Said process stages are then repeated, again until a boundary is reached, until the entire object to be coated is provided with the base coat layer.

A process for repair coating by means of a blend-in-system is described in EP-A-719 185 wherein an aqueous base coat is applied in a covering finish to the damaged part in one spray pass, and whilst the base coat is applied to the zones of the existing coating adjacent to the defect the spray gun is inclined towards the defect such that the spray gun forms an angle between 25 and 65° with the surface of the existing coating.

It has not yet been possible, however, to improve the above-mentioned disadvantages satisfactorily with the application methods known in the prior art, so there is still a need for further improved processes for multi-layer repair coating with water-based base coats.

The object of the invention was, therefore, to provide a process for the multi-layer repair coating of substrates, particularly of vehicles, which makes it possible to apply water-based base coats of good quality similar to that of conventional solvent-based base coats. The water-based base coats, particularly special effect water-based base coats, should have a low clouding tendency during application and good special effect development. No wetting faults in respect of the substrate should occur. The water-based base coat layers should exhibit good clear coat gloss and flow when coated over with clear coats. Moreover, shorter flash-off times are required. The relatively high build-up of coating material at critical places such as corners, edges or flanges should also be improved.

SUMMARY OF THE INVENTION

The object of the invention is achieved by a process for the multi-layer repair coating of substrates wherein a base coat layer of a colour- and/or special effect-imparting water-based base coat coating composition is applied to a pre-coated substrate and a clear coat layer of a transparent clear coat coating composition is applied to the base coat layer thus obtained, which is characterised in that the base coat layer of the water-based base coat coating composition is applied in three successive spray passes and each spray pass is executed such that uniform, adjacent and substantially non-overlapping coating strips are applied to the substrate surface to be coated.

DETAILED DESCRIPTION OF THE EMBODIMENTS

The application of the water-based base coats takes place according to the invention in three successive spray passes, i.e., the water-based base coats are applied in three successive layers. The spray passes to be executed are not normal full spray passes but so-called half spray passes (0.5 spray pass). The peculiarity of these in comparison with a normal full spray pass (1 spray pass) is that no uniformly continuous coating film is formed on the substrate surface by the coating applied in an individual half spray pass, when considered by itself. Effectively, an incompletely and non-uniformly covering coating layer with an incomplete covering capacity is applied with a half spray pass. The term covering capacity in this context means the ability to cover up the colour or the colour differences of the substrate (see DIN 55 987: 1981-02). Only by virtue of the combination of the three coating layers to be applied in the three half spray passes is a covering coating layer obtained with a uniformly continuous coating surface. A half spray pass is also described in coating terminology as a thin, open spray pass. A half spray pass is not, however, an over-spraying spray pass. The coatings expert is familiar with the terms "normal full" spray pass and "half" spray pass and with the equivalent terms that may be used and is able to translate these terminological definitions into practice without difficulty.

A spray pass is generally executed in such a way that uniform coating strips are applied on the surface to be coated, i.e., the coating material is applied in uniform parallel strips with the spray gun until the entire surface is coated. The spray gun is passed evenly over the spray surface at an angle of approximately 90°. One applied coating strip has a layer thickness gradient over the width of the coating strip such that a decrease in layer thickness to as little as 0 $\mu$m towards the edges of the coating strip is obtained and a layer thickness maximum is present in the central zone of the coating strip which approximately corresponds to the desired layer thickness to be applied. In order to produce a covering coating film with a uniformly continuous film surface on the substrate to be coated with one spray pass, each coating strip applied on the surface should therefore usually overlap by about half with the preceding applied coating strip, within one spray pass (see, e.g., "Das Fachwissen für den Maler und Lackierer", Stam-Verlag Cologne, Munich, 2nd edition 1989, p. 169, 170). According to the invention, however, not withstanding this, each spray pass is executed in such a way that adjacent, substantially non-overlapping coating strips are applied. Substantially non-overlapping in this context means non-overlapping or only slightly overlapping, whereby the zones of overspray between two adjacent coating stripes may quite overlap. In this way, an incompletely and non-uniformly covering coating film with a non-uniformly continuous surface is produced with one spray pass. The next spray pass in each case is then advantageously applied such as to be at least partially offset in relation to the preceding spray pass, i.e., the coating strips of the subsequent spray pass in each case are applied in such a way that they lie with the maxima of their layer thickness substantially over the zone of the coating strips applied with the preceding spray pass in which two coating strips are adjacent. As a result of this mode of pass, a uniformly continuous coating film surface is ultimately obtained and hence a substrate surface coated in a uniformly covering manner.

Operations are carried out preferably such that, with each of the three spray passes, the amount of coating applied is such that the resulting dry film layer thickness of the base coat layer applied with one spray pass is equivalent to approximately one third of the dry film layer thickness of the entire base coat layer to be applied.

Surprisingly, it has now been found that when the process according to the invention is used for the application of water-based base coat coating compositions, the quality of the coatings produced from the water-based base coat coating compositions can be improved markedly, particularly in terms of special effect formation, clouding, substrate wetting, build-up at comers and edges and final flash-off time.

The application of the water-based base coat compositions may be carried out with conventional application devices, i.e., with spray guns and corresponding nozzle and air cap equipment which may be conventionally used for vehicle repair coating. Spray guns, which may be used, are the HVLP spray guns (HVLP=High Volume Low Pressure; e.g. SATA Jet B NR95, SATA Jet NR 2000), normal pneumatic high performance spray guns (e.g. SATA Jet MSB, SATA Jet 90), and Airmix spray guns familiar to the skilled person. Suitable nozzles are the conventional nozzles for the corresponding spray guns, which are known to the skilled person and sold by the spray gun manufacturers. Nozzles of varying nozzle width may be used, for example, with nozzle widths from 0.8 to 2.2 mm. The nozzle width depends inter alia on the spray gun used. Nozzle widths from 1.2 to 1.6 mm, for example, are suitable for gravity-feed cup guns, and nozzle widths from 1.7 to 1.8 mm, for example, are suitable for suction-feed cup guns. In the process according to the invention, nozzles with the following parameters are used in preference:

Material throughput: approximately 170 to 180 g of coating composition per minute (at a processing viscosity of 24 s (DIN 4 mm/20° C.));

Width of spray jet (width of the spray jet impinging on the substrate surface): approximately 27 to 28 cm (at a spraying distance, that is, the distance between the nozzle and the substrate surface to be coated, of 15 cm and a spray gun intake pressure of 2.0 bar).

It is possible to operate with normal or optionally slightly reduced spray gun pressure. The spray gun intake pressure is preferably between 2.0 and 4.5 bar. The spray gun output pressure varies depending on the spray gun used. If an HVLP gun is used, it is, for example, about 0.6 to 0.9 bar, in the case of conventional high-pressure guns, for example, 2.0 to 4.5 bar.

The distance between spray gun and substrate to be coated "spray distance" may be, for example, 15 to 30 cm during application. Preferred the second and third spray pass may carried out with an increased distance compared to the first spray pass, for example by 5–15%.

As already described above, in each of the three spray passes, the amount of coating composition applied is preferably such that the coating layer applied with one spray pass has a theoretically resulting dry film layer thickness which is equivalent to approximately one third of the dry film layer thickness of the entire water-based base coat layer to be applied. The total layer thickness to be applied during the application of water-based base coats may generally be about 10 $\mu$m to 30 $\mu$m, given as dry film layer thickness. The layer thickness varies as a function of the water-based base coat used. For example, in the case of single-colour water-based base coats, about 20 to 25 $\mu$m and in the case of special effect water-based base coats, e.g. water-based base coats pigmented with metallic pigments and/or interference pigments, about 10 to 20 $\mu$m may be applied. For each individual spray pass, a corresponding layer thickness from about 4 to 10 $\mu$m is obtained.

The individual spray passes may be executed successively with or without intermediate flash-off. For example, intermediate flash-off times from 10 to 30 minutes are possible, depending on the relative humidity. A particular advantage of the process according to the invention is, however, that an intermediate flash-off may be dispensed with in order to obtain good results. Advantageously, the individual spray passes may therefore be executed successively in each case, without intermediate flash-off.

In principle, there are no restrictions with regard to the water-based base coat, which may be applied with the process according to the invention. These may be conventional water-based base coats known to the skilled person and which may be used in vehicle coating, particularly vehicle repair coating. The water-based base coats may be formulated as one-component or two-component coatings.

The water-based base coats contain water-dilutable binders. The water-based dilutable binders are conventional water-dilutable polyurethane, polyester and/or poly(meth) acrylic resins and modified resins thereof known to the skilled person. The modified resins are, for example, (meth) acrylated polyesters and/or (meth)acrylated polyurethanes. The water-dilutable binders mentioned are ionically and/or non-ionically modified in order to obtain sufficient water dilutability.

In preference, water-dilutable polyurethane resins or mixtures thereof are used in the water-based base coats. Suitable water-dilutable polyurethane resins are those, for example, with an average molecular weight Mn from 500 to 200,000 g/mol, preferably 1,000 to 50,000 g/mol, an acid value from 15 to 150 mg KOH/g, preferably from 20 to 100 mg KOHWg, and a hydroxyl value from 0 to 400 mg KOH/g. Polyurethane resins used in preference are obtained by reaction of isocyanate-functional polyurethane prepolymers with compounds which are reactive towards isocyanate groups. The water-dilutable polyurethane resins may also be used in modified form, for example as silicon-modified or acrylated polyurethane resins. Examples of water-dilutable polyurethane resins, which may be used, are described in DE-A-43 39 085, DE-A-39 36 794, DE-A-43 44 063, DE-A-41 15 015, DE-A-41 22 265, DE-A-196 43 802 and EP-A-089 497.

The polyurethane resins or mixtures of polyurethane resins, which may be used in preference, may also be used in combination with other water-dilutable binders mentioned above. Similarly, paste resins for grinding the pigments may be used in the water-based base coats, for example, those described in EP-A-297 576.

The water-dilutable binders may dry physically or may be crosslinked by forming covalent bonds. Potential crosslinkable groups are, for example, hydroxyl, amino, carboxyl, epoxy, acetoacetyl and unsaturated groups. If crosslinkable groups are present they are preferably hydroxyl groups.

The water-dilutable binders may be self-crosslinking or, preferably, externally crosslinking. In the latter case, the water-based base coats also contain crosslinking agents. The choice of crosslinking agents depends on the crosslinkable functional groups present in the water-dilutable binders. In the case of preferred hydroxyl group-containing binders which may be used, the crosslinking agents used in preference are polyisocyanates. These are, in particular, the conventional coating polyisocyanates with which the skilled person is sufficiently familiar.

Water-based base coats which may be used also contain colour- and/or special effect-imparting pigments. Suitable colour-imparting pigments are all the customary coating pigments of an organic or inorganic nature. Examples of inorganic or organic colour-imparting pigments are titanium dioxide, micronized titanium dioxide, iron oxide pigments, carbon black, azo pigments, phthalocyanine pigments, quinacridone, perylene or pyrrolopyrrole pigments. Examples of special effect pigments which may be used are metallic pigments, e.g., of aluminium or copper, interference pigments such as, e.g., metal oxide-coated metallic pigments, e.g., titanium dioxide-coated, iron oxide-coated or mixed oxide-coated aluminium, coated mica, such as, e.g., titanium dioxide-coated mica and/or mica coated with other metal oxides, e.g. with $Fe_2O_3$ and/or $Cr_2O_3$, iron oxide flake and graphite pigments. The pigments may be used individually or in combination.

Water-based base coats which may be used may also contain organic solvents and customary coating additives.

The organic solvents are conventional coating solvents. These may originate from the preparation of the binders or be added separately. Examples of suitable solvents are monohydric or polyhydric alcohols, e.g. propanol, butanol, hexanol, glycols, e.g., ethylene glycol, propylene lycol, glycol ethers or esters, e.g., diethylene glycol dialkyl ether, dipropylene glycol dialkyl ether, in each case with C1 to C6 alkyld ethoxypropanol, butyl glycol, N-methylpyrrolidone and ketones, e.g., methyl ethyl ketone, acetone, cyclohexanone, aromatic or aliphatic hydrocarbons, e.g., toluene, xylene, or straight-chain or branched aliphatic C6–C12 hydrocarbons. Water-miscible solvents are used in preference.

Examples of conventional coating additives are leveling compositions, rheology-influencing compositions, thickeners, defoamers, wetting compositions, anti-crater compositions, dispersing compositions, light protecting compositions, bonding compositions, initiators and curing accelerators. The additives are used in conventional amounts known to the skilled person.

Prior to application, the spray viscosity of the water-based base coats may be adjusted, if necessary, with water and/or organic solvents.

The water-based base coats are applied to precoated substrates. Suitable substrates are metal and plastic substrates, particularly the substrates known in the automotive industry, such as, e.g., iron, zinc, aluminium, magnesium or alloys thereof, and polyurethanes, polycarbonates, or polyolefins. Said substrates are usually precoated, for example, with conventional primers and/or conventional primer surfacers. The primers and/or primer surfacers may be conventional coating compositions of the kind used as primer surfacers and/or primers by the skilled person in vehicle coating. For example, they may be primer and/or primer surfacer layers applied within the context of repair coating, with binders based on e.g. binders that dry physically, such as physically drying polyurethane and/or polyacrylic resins, and chemically crosslinking binders, such as epoxy resins and polyamine hardeners or hydroxy-functional resins and polyisocyanate crosslinking compositions. The primers and/or primer surfacers used may be solvent-based or water-based. The water-based base coats may also, however, be applied to intact existing coatings (factory or repair coatings) or primed new parts, e.g. primed plastics parts.

The water-based base coats applied with the process according to the invention may be dried and/or cured after application. This may take place, for example, at room temperature or by forced drying at higher temperatures, e.g. up to 80° C. , preferably at 40° C. to 60° C. The coatings may also, however, be cured at higher temperatures from, for example, 80° C. to 150° C.

The applied water-based base coats are then coated over with clear coats. The clear coats may be applied to the base coat layer either after drying and/or curing of the base coat layer or wet-on-wet, optionally after a flash-off phase. The clear coats are applied preferably wet-in-wet to the base coat layer. The flash-off time may be, for example, 15 to 45 minutes, depending on the relative humidity. According to the invention, however, it is possible to operate with shorter flash-off times from about 15 to 25 minutes compared with the prior art.

In principle, suitable clear coats are all the well-known non-pigmented or transparent-pigmented coating compositions of the kind customarily used, for example, in motor vehicle coating. The clear coats may be solvent-based or water-based. In particular, they are two-component clear coats based on chemically crosslinking binders, for example, based on hydroxy-functional binder components and polyisocyanate crosslinking compositions. The clear coats may be cured as described above for the curing of the base coat. For example, curing may be carried out at room temperature over a period of several hours or by forced drying at temperatures from, for example, 40° C. to 60° C. , e.g., within 30 to 80 minutes. If binders that can be cured using high-energy radiation are used, curing may also be carried out using UV radiation. In the case of the preferred wet-in-wet application of the clear coat, drying/curing of the base coat and clear coat takes place in a common step.

The water-based base coats applied with the process according to the invention produce advantageous coatings compared with the prior art. Hardly any wetting faults in respect of the substrate occur. The final flash-off time for the water-based base coats is effectively reduced and very good clear coat gloss and flow is obtained. Build-up of coating material at critical places such as flanges, edges and corners does not take place or may be minimized. More particularly, during the application of special effect water-based base coats, there is only a very slight tendency towards clouding, and a perfect uniform special effect development is obtained. Compared with conventional application processes, a comparable covering capacity is achieved with less coating material with the same water-based base coat.

The invention will be explained in more detail on the basis of the examples below.

EXAMPLES

Example 1

A commercial solvent-based two-component primer surfacer coating composition (isocyanate-crosslinking) (Standox® 2K-Nonstop-Füllprimer, Standoxe® 2-K Härter) was applied to a cathodic electrodeposition coated steel wing in a dry film layer thickness of about 60 μm, cured for 30 minutes at 60° C. and then sanded. A commercial water-based silver metallic base coat (Standohyd® Basecoat MIX 395) was applied as follows to the primer surfacer layer thus obtained, in a dry film layer thickness of a total of about 12 gm:

The water-based metallic base coat was applied in 3 half spray passes (3×0.5) with an HVLP spray gun (SATA Jet NR 2000 HVLP, nozzle parameters: nozzle width 1.3 mm, material throughput: 170 g of coating composition/min at a processing viscosity of 24 s (DIN 4 mm/20° C. ), jet width: 27.5 cm at a spraying distance of 15 cm). The spray gun intake pressure was 2.0 bar and the spray gun output pressure 0.7 bar. With each spray pass non-overlapping parallel spray strips are applied with a resulting dry film layer thickness of about 4 μm. The second and third spray passes were slightly offset in each case with respect to the preceding spray pass. No intermediate flash-off took place between the individual spray passes.

After a flash-off time of about 20 minutes, the water-based base coat layer obtained was then coated over with a commercial two-component solvent-based clear coat (isocyanate-crosslinking) (Standocryl® 2K HS-Klarlack, Standox® 2K HS-Härter, long) in one pass (initially a half spray pass, then a normal continuous spray pass). The SATA Jet 90 spray gun was used in this case. After a flash-off time of 10 minutes the coating was cured for 30 minutes at 60° C.

Example 2 (Comparative)

For comparison, the same procedure as in the above was used, except that the water-based silver metallic base coat (Standohyd® Basecoat MIX 395) was applied in a dry film layer thickness of a total of about 17 μm in 1.5 spray passes, i.e. with a normal continuous spray pass with spray stripes overlapping by about one half (dry film layer thickness: 12 μm) and a half, non-continuous finish spray pass (dry film layer thickness: 5 μm). The final flash-off time for the metallic water-based base coat was 34 minutes.

The results of the coating are shown in the table below.

| | Example 1 | Example 2 |
|---|---|---|
| Final flash-off time | 20 minutes | 34 minutes |
| Clouding | Not visible | Visible |
| Layer thickness | 12 μm | 17 μm |
| Covering capacity | Satisfactory | Satisfactory |
| Build-up of coating material at corners, edges and flanges | No build-up | Moderate build-up |
| Substrate wetting (1) | No interference | Considerable interference |

(1) On one place, water used during sanding was allowed to evaporate on the filler substrate in order to simulate a less than optimum substrate finish and hence to test the sensitivity of the substrate wetting.

Compared with the comparison example, the same satisfactory covering capacity (DIN 55945, coating materials) was achieved in the example according to the invention with a smaller layer thickness i.e. less coating material. Moreover, a finer and more uniform appearance in terms of special effect development was obtained in the example according to the invention.

What is claimed is:

1. A process for the multi-layer repair coating of substrates, wherein a base coat layer of a water-based base coat coating composition is applied to a precoated substrate and a clear coat layer of a transparent clear coat coating composition is applied to the base coat layer thus obtained, characterised in that the base coat layer of the water-based base coat coating composition is applied in three successive spray passes, and each spray pass is executed such that uniform, adjacent and substantially non-overlapping coating strips are applied to the substrate surface to be coated.

2. The process of claim 1, characterised in that the water-based base coat coating composition contains at least one special effect pigment.

3. The process of claim 1, characterised in that the second and third spray pass are executed such as to be at least partially offset in each case with respect to the preceding spray pass, so that the coating strips of the subsequent spray pass in each case lie with the maxima of their layer thickness substantially over the zone of the coating strips applied with the preceding spray pass in which two coating strips are adjacent.

4. The process of claim 1, characterised in that the amount of coating composition applied with each of the three spray passes is such that the resulting dry film layer thickness of the base coat layer applied with one spray pass is equivalent to about one third of the dry film layer thickness of the entire base coat layer to be applied.

5. A process of claim 1, characterised in that the water-based base coat is applied with spray gun nozzles having, as nozzle parameters, a material throughput from 170 to 180 g of coating composition per minute, at a processing viscosity of 24s and a width of the spray jet from 27 to 28 cm at a spraying distance of 15 cm and a spray gun intake pressure of 2.0 bar.

6. A process of claim 1, characterised in that there is no flash-off time between the first and second spray pass and between the second and third spray pass.

7. A process of claim 1, characterised in that the precoated substrate is selected from vehicles and vehicle parts.

* * * * *